US008525859B2

(12) United States Patent
Yamada et al.

(10) Patent No.: US 8,525,859 B2
(45) Date of Patent: Sep. 3, 2013

(54) THERMAL HEAD AND THERMAL PRINTER

(75) Inventors: Koji Yamada, Okaya (JP); Akira Koyabu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 115 days.

(21) Appl. No.: 13/304,862

(22) Filed: Nov. 28, 2011

(65) Prior Publication Data

US 2012/0133723 A1 May 31, 2012

(30) Foreign Application Priority Data

Nov. 26, 2010 (JP) ..... 2010-263220
Mar. 23, 2011 (JP) ..... 2011-063444

(51) Int. Cl.
*B41J 2/335* (2006.01)

(52) U.S. Cl.
USPC ..... 347/200

(58) Field of Classification Search
USPC ..... 347/200–211
See application file for complete search history.

(56) References Cited

U.S. PATENT DOCUMENTS

| | | | | |
|---|---|---|---|---|
| 6,339,444 | B1 * | 1/2002 | Sugiyama | 347/200 |
| 7,145,584 | B2 * | 12/2006 | Terao et al. | 347/200 |
| 7,270,493 | B2 | 9/2007 | Unotoro | |
| 7,554,567 | B2 * | 6/2009 | Nakanishi | 347/200 |

FOREIGN PATENT DOCUMENTS

| | | | |
|---|---|---|---|
| JP | 03-153363 | A | 7/1991 |
| JP | 09-095018 | A | 4/1997 |
| JP | 10-250127 | A | 9/1998 |
| JP | 2006-088584 | A | 4/2006 |
| JP | 2010-167756 | A | 8/2010 |

* cited by examiner

*Primary Examiner* — Kristal Feggins
(74) *Attorney, Agent, or Firm* — Nutter McClennen & Fish LLP; John J. Penny, V

(57) ABSTRACT

A thermal head enables printing even after printing for a long time to a print medium with low paper quality. A thermal head 20 to which a print medium P is pressed by a platen roller 10 has a heat unit 21 with a plurality of heat elements 21*a* arrayed on an axis, and an electrode connection unit 26 that is formed on an extension of the axis. A receptive space A to which the end 11*a* of the platen roller 10 contact surface 11 that is pressed to the thermal head 20 is positioned is formed on this axis between the heat unit 21 and the electrode connection unit 26.

20 Claims, 10 Drawing Sheets

THERMAL HEAD AND THERMAL PRINTER

BACKGROUND

1. Technical Field

The present invention relates to a thermal head and to a thermal printer that uses the thermal head.

2. Related Art

Thermal printers that print by conveying thermal paper or other print medium enabling thermal printing over a thermal head having heating elements disposed thereto are known from the literature. See, for example, Japanese Unexamined Patent Appl. Pub. JP-A-2006-88584.

FIG. 8 is a section view of the print unit in the thermal printer 201 described in JP-A-2006-88584. The thermal head 220 disposed in this thermal printer 201 is pushed to the platen roller 210 side by a coil spring 206, and the print medium P is thereby held between the platen roller 210 and the thermal head 220. This type of thermal printer 201 prints by causing the print medium P to change color by applying heat thereto by means of the thermal head 220.

When this thermal printer 201 according to the related art prints for an extended period of time to a low quality, coarse print medium P with high surface roughness, parts of the common electrodes 225 may wear and fail as a result of the print medium P repeatedly wearing a particular part of the common electrode 225 of the thermal head 220 (see FIG. 9), eventually resulting in an inability to print.

To further describe this problem, FIG. 9 shows a top view of the main parts of a common thermal head 220. The contact surface 211*a* pressed by the platen roller 210 against the thermal head 220 is indicated by a double-dot dash line in FIG. 9.

As shown in FIG. 9, a heat unit 221 having a plurality of heat elements 221*a* arrayed in a line is formed on the substrate 223 of the thermal head 220. A plurality of drive electrodes 224 that supply drive current to the heat elements 221*a* are formed on the substrate 223 on one side of the linear heat unit 221, and are connected to a drive chip not shown.

A common electrode 225 that is conductive with each of the heat elements 221*a* is also formed on the substrate 223 on the other side of the heat unit 221. The common electrode 225 communicates with the drive electrode 224 side through a electrode connection unit 226 that is formed at the end of the heat unit 221 array, and is connected to an external connector not shown.

The rotational axis Ax of the platen roller 210 is disposed opposite the thermal head 220 aligned with the alignment axis of the plural heat elements 221*a* so that the print medium P can be efficiently pressed against the heat unit 221, and is affixed to the frame of the thermal printer 201 not shown. The print medium P is held between the platen roller 210 and the thermal head 220 as a result of the thermal head 220 being pushed to the platen roller 210 side by the coil spring 206.

The width of the platen roller 210 is greater than the width (the left-right direction in FIG. 8) of at least the heat unit 221 so that the print medium P can be reliably pressed against the heat unit 221. As a result, the platen roller 210 is pressed through the intervening print medium P to the heat unit 221 and the electrode connection unit 226 that is disposed on the axial end 221*c* side of the heat unit 221. While the thermal head 220 and platen roller 210 meet at the contact surface 211*a*, pressure is particularly great on the area 211*b* of the contact surface 211*a* that is closest to the rotational axis Ax because the platen roller 210 is a cylinder centered on the rotational axis Ax.

The common electrode 225 including the electrode connection unit 226 is thicker than the drive electrodes 224 and the heat elements 221*a* in order to carry the combined current flowing from the plural heat elements 221*a*. A protective coating is also formed over the electrode connection unit 226 and the heat elements 221*a*. However, as the protective coating on the electrode connection unit 226 is worn by the print medium P, the electrode connection unit 226, which is softer than the coating, becomes worn in spots. More particularly, as shown in FIG. 10, the part 226*a* of the electrode connection unit 226 that is opposite the pressure area 211*b* of the platen roller 210 becomes worn as shown in FIG. 10.

As the electrode connection unit 226 continues to wear and the common electrode 225 finally fails in this part 226*a* of the electrode connection unit 226, conductivity is lost between the external connector and the common electrode 225, and the heat unit 221 cannot be driven. The thermal printer 201 thus becomes unable to print when a low quality, coarse print medium P is used for a long time.

SUMMARY

The present invention is directed to solving this problem by providing a thermal head in which the electrodes are not broken even after printing to a low quality, coarse print medium for a long time, and a thermal printer having this thermal head.

A first aspect of the invention is a thermal head to which a print medium is pressed through an intervening platen roller, the thermal head including a heating unit having a plurality of heat elements arrayed on an axis, and an electrode unit formed on a linear extension of the axis. A receptive space to which an end part of the platen roller contact surface that is pressed to the thermal head is formed on the axis between the heating unit and the electrode unit.

The thermal head according to this aspect of the invention positions the end of the contact (pressure) surface of the platen roller in a receptive space between the heating unit and the electrode unit in the axial direction of the heat elements. The electrode unit is thus not worn by the platen roller, and the electrode unit will not be interrupted. A thermal head that can be used for a long time without electrode disconnections can therefore be provided.

In a thermal head according to another aspect of the invention, the receptive space is filled with hard glass.

By filling the receptive space of the thermal head with hard glass, direct conductivity between the heat elements and the electrode unit resulting from moisture getting into the receptive space can be prevented, and a more highly reliable thermal head can be provided.

In a thermal head according to another aspect of the invention, a dummy heat element that does not produce heat is disposed to the receptive space side end of the heating unit, or in the receptive space.

The thermal heads according to these aspects of the invention can improve print quality because the heat elements disposed at the axial end of the array and the heat elements disposed in the middle of the array can be driven to heat uniformly by providing a dummy heat element. In addition, even if the dummy heat element is disposed to the receptive space and is exposed by the platen roller, printing can continue because the dummy heat element does not directly affect the printing operation, and a thermal head with a long service life can be provided.

Another aspect of the invention is a thermal printer including a thermal head including a heating unit having a plurality of heat elements arrayed along an axis, and an electrode unit formed on a linear extension of the axis with a receptive space between the electrode unit and the heating unit; and a platen roller that presses a print medium to the thermal head. An end part of the platen roller contact surface that is pressed to the thermal head is positioned in the axial direction to the receptive space.

In a thermal printer according to this aspect of the invention, the end part of the platen roller contact surface that is pressed to the thermal head is positioned in the receptive space. The electrode unit is thus not worn by the platen roller, and the electrode unit will not be interrupted. A thermal printer with a thermal head that can be used for a long time without electrode disconnections can therefore be provided.

In a thermal printer according to another aspect of the invention the receptive space is filled with hard glass.

By filling the receptive space of the thermal head with hard glass in the thermal printer according to this aspect of the invention, direct conductivity between the heat elements and the electrode unit can be prevented, and a more highly reliable thermal printer can be provided.

In a thermal printer according to another aspect of the invention, a dummy heat element that does not produce heat is disposed to the receptive space side end of the heating unit, or in the receptive space.

The thermal printers according to these aspects of the invention can improve print quality because the heat elements disposed at the axial end of the array and the heat elements disposed in the middle of the array can be driven to heat uniformly by providing a dummy heat element. In addition, even if the dummy heat element is disposed to the receptive space and is exposed by the platen roller, printing can continue because the dummy heat element does not directly affect the printing operation, and a thermal printer with a long service life can be provided.

Another aspect of the invention is a thermal printer having a thermal head including a heating unit that extends in a direction perpendicular to a print medium conveyance direction, and an electrode unit formed on a linear extension of the axis on which the heating unit extends; and a platen roller that presses the print medium to the thermal head. The electrode unit is formed on the axis of the heating unit at a position separated from the heating unit so that the platen roller does not press against the electrode unit.

Because the electrode unit is formed at a position separated from the heating unit and is not pressed to the platen roller in a thermal printer according to this aspect of the invention, the electrode unit is not worn by the platen roller, and the electrode unit will not be interrupted. A thermal printer with a thermal head that can be used for a long time without electrode disconnections can therefore be provided.

In a thermal printer according to another aspect of the invention the receptive space is filled with hard glass.

By filling the receptive space of the thermal head with hard glass in the thermal printer according to this aspect of the invention, direct conductivity between the heat elements and the electrode unit can be prevented, and a more highly reliable thermal printer can be provided.

In a thermal printer according to another aspect of the invention, a dummy heat element that does not produce heat is disposed to the receptive space side end of the heating unit, or in the receptive space.

The thermal printers according to these aspects of the invention can improve print quality because the heat elements disposed at the axial end of the array and the heat elements disposed in the middle of the array can be driven to heat uniformly by providing a dummy heat element. In addition, even if the dummy heat element is disposed to the receptive space and is exposed by the platen roller, printing can continue because the dummy heat element does not directly affect the printing operation, and a thermal printer with a long service life can be provided.

Another aspect of the invention is a thermal printer including: a thermal head having an electrode unit formed on an extension of the alignment axis of a plurality of heat elements outside the area of the heat elements; and a platen roller that presses a recording medium to the thermal head. Wherein the platen roller is formed so that, of the axial end of the heat elements and the plural ends of the electrode unit located on an axial extension of the heat elements, an end part of the thermal head contact surface of the platen roller is positioned between the axial end of the heat elements and the end of the electrode unit that is located farthest therefrom.

In a thermal printer according to this aspect of the invention, the alignment axis end of the contact surface of the platen roller is positioned between the axial end of the heating unit and the axial end of the electrode unit. More specifically, the contact surface of the platen roller that presses the print medium to the thermal head is not formed to the axial end of the electrode unit. No part of the electrode unit is therefore pressed against the print medium, and the electrode unit is therefore not interrupted. A thermal printer that can be used for a long time without electrode interruptions can therefore be provided.

In a thermal printer according to another aspect of the invention, the thermal head has a dummy heat element that does not produce heat on the axial end part of the heating unit; and the platen roller is formed so that the axial end of the contact surface overlaps the area where the dummy heat element is located.

The thermal printer according to this aspect of the invention can improve print quality because the heat elements disposed at the axial end of the array and the heat elements disposed in the middle of the array can be driven to heat uniformly by providing a dummy heat element. In addition, even if the dummy heat element is exposed by the platen roller, printing can continue because the dummy heat element does not directly affect the printing operation, and a thermal printer with a long service life can be provided.

DESCRIPTION OF EMBODIMENTS

Preferred embodiments of the present invention are described below with reference to the accompanying figures.

Figure 1:
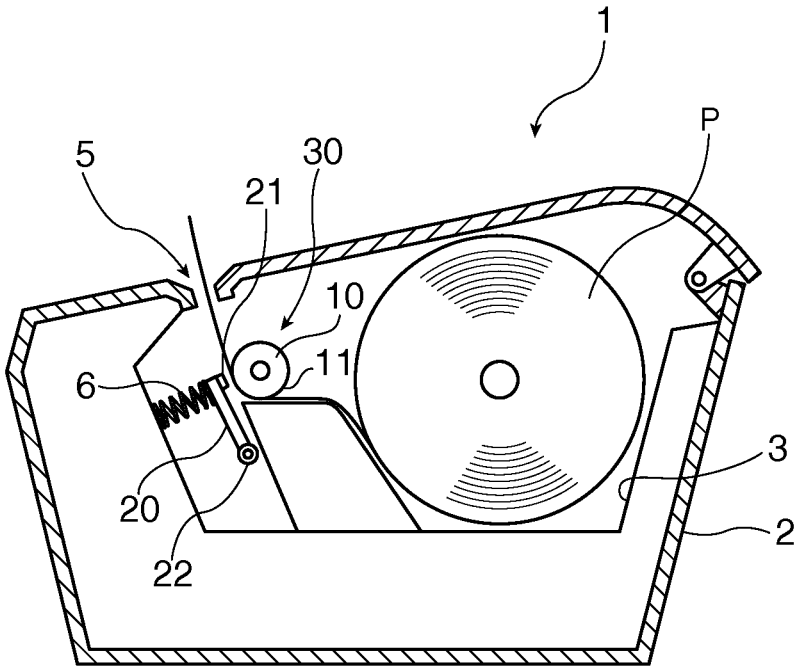
FIG. 1 is a section view of a thermal printer according to a preferred embodiment of the invention.

FIG. 1 is a section view of a thermal printer 1 according to a preferred embodiment of the invention. The thermal printer 1 shown in FIG. 1 prints by pressing a heat unit 21 that produces heat against a print medium P such as thermal paper that changes color when heat is applied to the print medium.

The thermal printer 1 has a housing 2, a paper compartment 3 for storing the print medium P (thermal roll paper in this example), a print unit 30 including a platen roller 10 and thermal head 20, and a drive unit (not shown in the figure) including gears and a motor for rotating the platen roller 10 and conveying the print medium P. After printing by the print unit 30, the print medium P is discharged from a paper exit 5.

The print unit 30 includes a platen roller 10 with a rotational shaft axially supported by the housing 2, and a thermal head 20 disposed so that the heat unit 21 is opposite the platen roller 10. The thermal head 20 is a flat member having a pivot shaft 22 that is axially supported by the housing 2 disposed to one end, and the heat unit 21 disposed to a position separated from the pivot shaft 22. The flat thermal head 20 is constantly urged toward the platen roller 10 by an urging member 6 such as a coil spring having one end fastened to the housing 2.

Figure 2:
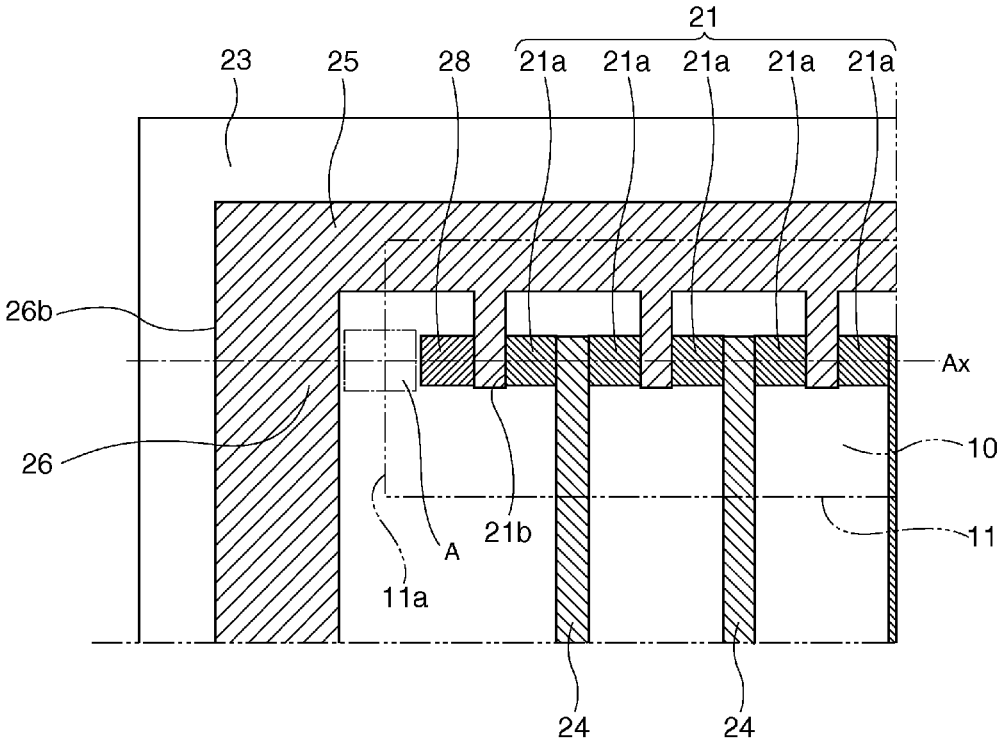
FIG. 2 is an enlarged front view of part of the thermal head in the thermal printer shown in FIG. 1.

FIG. 2 is an enlarged front view of parts of the thermal head 20 shown in FIG. 1. A plurality of heat elements 21*a* rendering the heat unit 21 are disposed in a line perpendicular to the conveyance direction of the print medium P (left-right as seen in FIG. 2) on a substrate 23 of the thermal head 20. A plurality of mutually independent drive electrodes 24 extending from the pivot shaft 22 side to the heat element 21*a* side are formed on the substrate 23, and are conductive with the corresponding heat elements 21*a*. The drive electrodes 24 are connected to a drive chip not shown and selectively supply current to the heat elements 21*a* according to the print data, thereby causing the heat elements 21*a* to emit heat and print.

A common electrode 25 that is conductive to the heat elements 21*a* is disposed to the heat unit 21 on the opposite side as the pivot shaft 22 of the thermal head 20. The common electrode 25 has an electrode connection unit 26 (electrode unit) outside the area of the heat unit 21 where the heat elements 21*a* are formed in a line along the axis of the heat unit 21 (outside the axial ends 21*b* shown in the figure).

The plural heat elements 21*a* are formed on a glass glaze layer 29 (see FIG. 7) in order to align the heat elements 21*a* to the same height (elevation). A flat glaze layer 29 can be formed on the surface of the substrate 23 by coating the substrate 23 with molten glass. The heat unit 21 can therefore be formed with the heat elements 21*a* aligned to the same height even when there are minute variations in the surface roughness of the substrate 23 by disposing the heat elements 21*a* to the flat top surface of the glaze layer 29, and a thermal printer 1 with excellent print quality can thus be provided.

The common electrode 25 extends through the electrode connection unit 26 to the pivot shaft 22 side, and conducts current supplied from the drive electrodes 24 to the heat elements 21*a* to an outside connector not shown. Because current supplied to the heat elements 21*a* flows together in the common electrode 25, the common electrode 25 is thicker than the drive electrodes 24 so that sufficient current can be carried.

As shown in FIG. 2, a receptive space A is formed between the heat unit 21 and the electrode connection unit 26 in the axial direction of the heat elements 21*a*. More specifically, the electrode connection unit 26 is formed with the receptive space A between it and the heat unit 21 on an extension of the alignment axis of the heat element 21*a* array. The common electrode 25 and drive electrodes 24 are not formed in this receptive space A because the receptive space A is an area that is worn by the platen roller 10 as described below.

A dummy heat element 28 is formed adjacent to the electrode connection unit 26 on the axial end 21*b* side of the heat unit 21. The dummy heat element 28 is made from the same material as the heat elements 21*a*, but is not connected to a drive electrode 24 and does not produce heat. The dummy heat element 28 is provided to achieve a uniform thermal environment by rendering the area surrounding the heat element 21*a* adjacent to the dummy heat element 28 with the same material and shape as that around the heat elements 21*a* in the middle of the heat element 21*a* group. More specifically, by providing this dummy heat element 28, the heat element 21*a* adjacent to the dummy heat element 28 can output heat in the same way as the heat elements 21*a* in the middle of the array, thereby preventing printing problems at the end of the heat element array.

Note that the embodiment shown in FIG. 2 has only one dummy heat element 28, but a plurality of dummy heat elements 28 may be provided. Yet further, the dummy heat element 28 may be disposed in the heat unit 21 as shown in FIG. 2, or in the receptive space A.

The platen roller 10 that presses the print medium P to the thermal head 20 thus comprised is disposed directly above the heat unit 21 with its rotational axis Ax parallel to the alignment axis of the heat unit 21. The platen roller 10 is also disposed relative to the thermal head 20 so that the end 11*a* of the contact surface with the thermal head 20 is located in the receptive space A in the direction of the alignment axis of the heat elements 21*a*. In other words, the electrode connection unit 26 is formed at a position separated from the heat unit 21 with the receptive space A therebetween so that the platen roller 10 does not push against the electrode connection unit 26. Because the platen roller 10 therefore does not press against the electrode connection unit 26 even when the platen roller 10 is pressed against the thermal head 20, the electrode connection unit 26 does not wear and there is no danger of the common electrode 25 being interrupted. This effect is further described below with reference to the print unit 130 in other comparison models.

Figure 3:
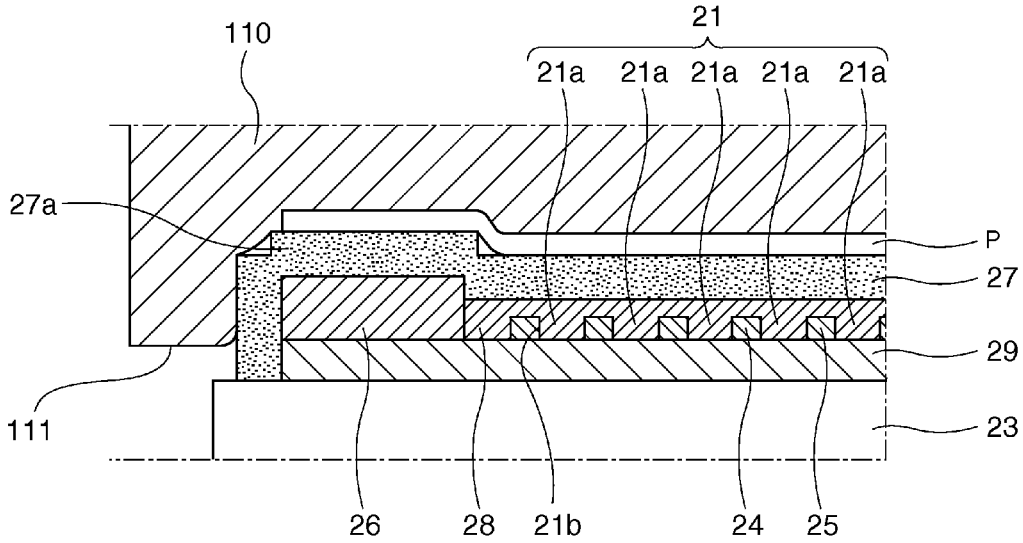
FIG. 3 is a section view of a print unit used for comparison.

FIG. 3 to FIG. 6 are section views of print units 130 used for comparison. As shown in FIG. 3, a coating 27 made of hard glass, for example, is disposed over the heat unit 21 and electrode connection unit 26 (on the platen roller 110 side) to prevent wear by the print medium P. This coating 27 is formed to the same uniform thickness as the heat unit 21 and electrode connection unit 26. As described above, because the electrode connection unit 26 is thicker than the heat unit 21 in order to carry more current, a bump 27*a* is formed in the surface of the thermal head 20 at the electrode connection unit 26.

A reactive force (pressure) is therefore applied from the platen roller 110 to the thermal head 20 at the contact surface 111 of the platen roller 110 in response to the urging force applied by the urging member 6 to the thermal head 20. Because the platen roller 110 is made of rubber or other elastic material, the contact surface 111 thereof deforms when this contact pressure is applied as shown in FIG. 3. Because the contact surface 111 is compressed by the bump 27*a* in the coating 27 when the contact surface 111 is pressed against the coating 27 formed on the heat unit 21 and electrode connection unit 26, stress is concentrated on the bump 27*a* as shown in FIG. 3. As a result, only the bump 27*a* in the coating 27 is worn by the contact surface 111 of the platen roller 110 or the print medium P pressed to the contact surface 111.

Figure 4:
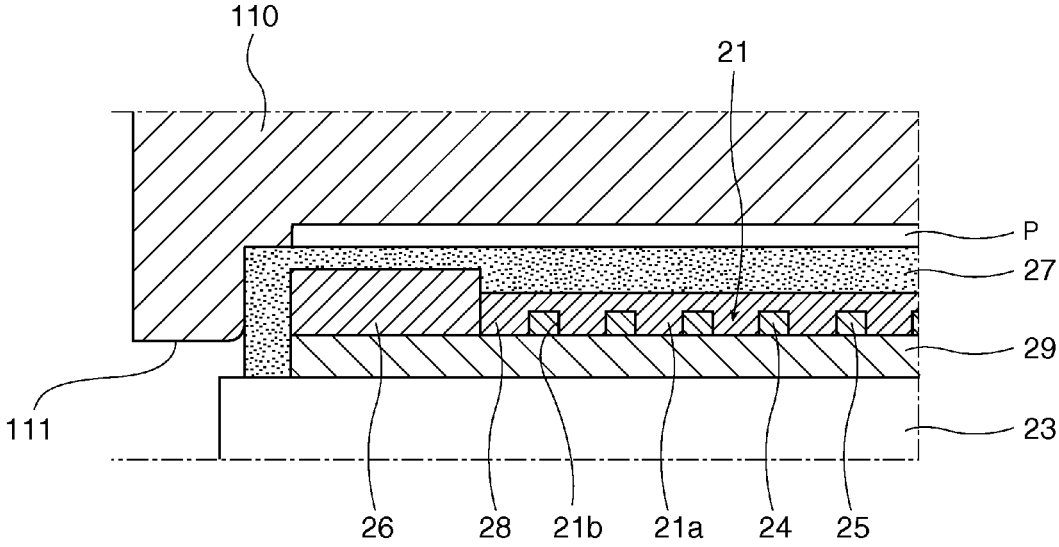
FIG. 4 is a section view of a print unit used for comparison.
Figure 5:
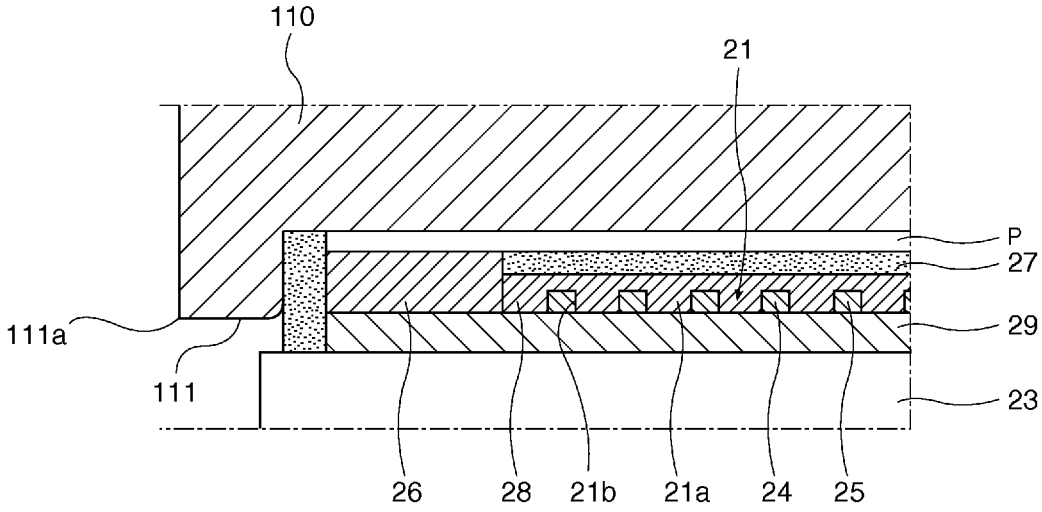
FIG. 5 is a section view of a print unit used for comparison.

As this wear progresses and only the bump 27*a* is worn down, the top of the coating 27 becomes worn down to a flat surface as shown in FIG. 4. When this happens and the entire surface of the coating 27 then wears, the electrode connection unit 26, which is thicker than the drive electrodes 24 and heat unit 21, becomes exposed at the top of the thermal head 20 as shown in FIG. 5. The electrode connection unit 26 is made of Au, Ag, Cu, or other metal, and has less wear resistance than the coating 27, which is made of hard glass such as borosilicate glass. Wear is therefore concentrated on the electrode connection unit 26 even if the same stress is applied from the print medium P through the contact surface 111 of the platen roller 110.

Figure 6:
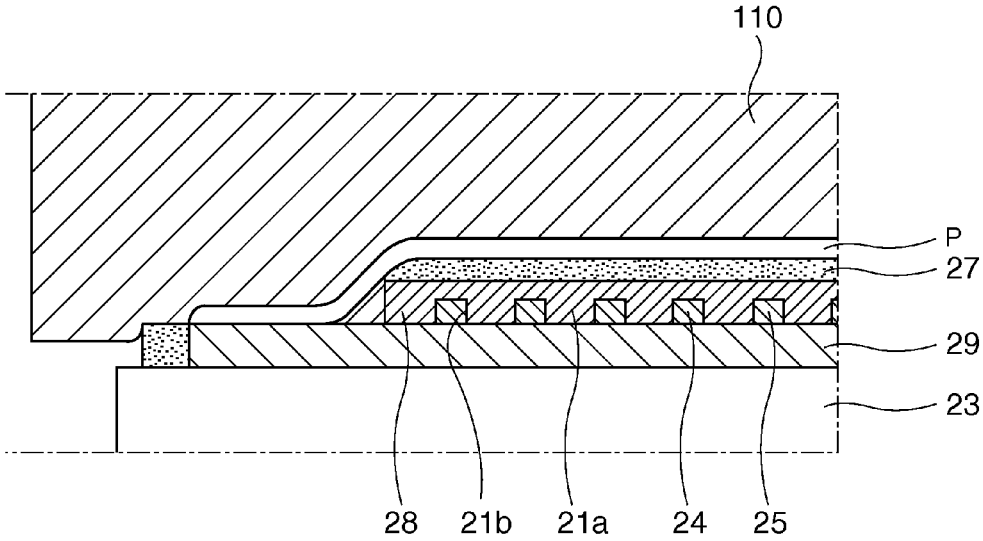
FIG. 6 is a section view of a print unit used for comparison.

Even if the top of the electrode connection unit 26 becomes lower than the top of the heat unit 21 as a result of continued wear of the electrode connection unit 26, the electrode connection unit 26 continues to be worn by the print medium P pressed thereto by the contact surface 111 of the platen roller 110 because the contact surface 111 of the rubber platen roller 110 elastically deforms and protrudes to the electrode connection unit 26 side. As a result, as the electrode connection unit 26 continues to wear, the common electrode 25 is eventually broken by the electrode connection unit 26 as shown in FIG. 6, becomes unable to supply current to the heat unit 21, and printing becomes impossible.

Figure 7:
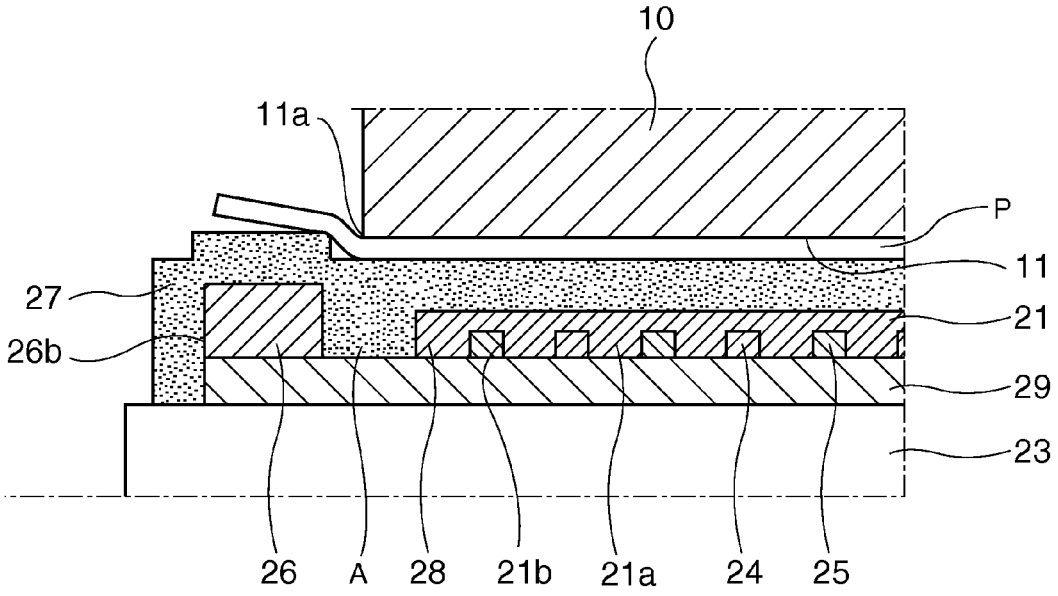
FIG. 7 is a section view of the print unit in the thermal printer shown in FIG. 1.
Figure 8:
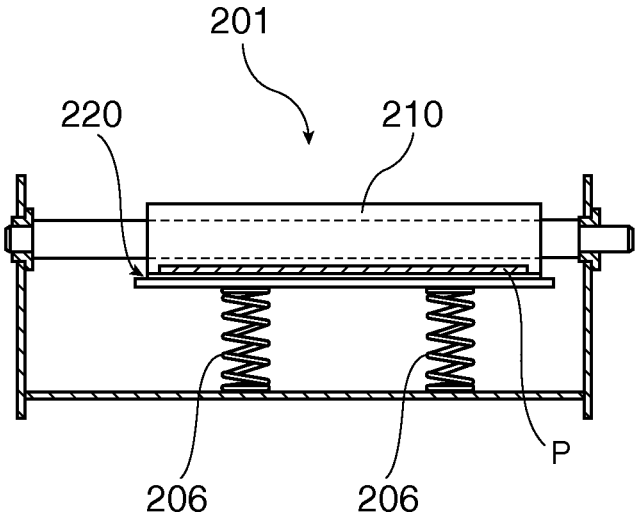
FIG. 8 is a section view of the print unit in a thermal printer according to the related art.
Figure 9:
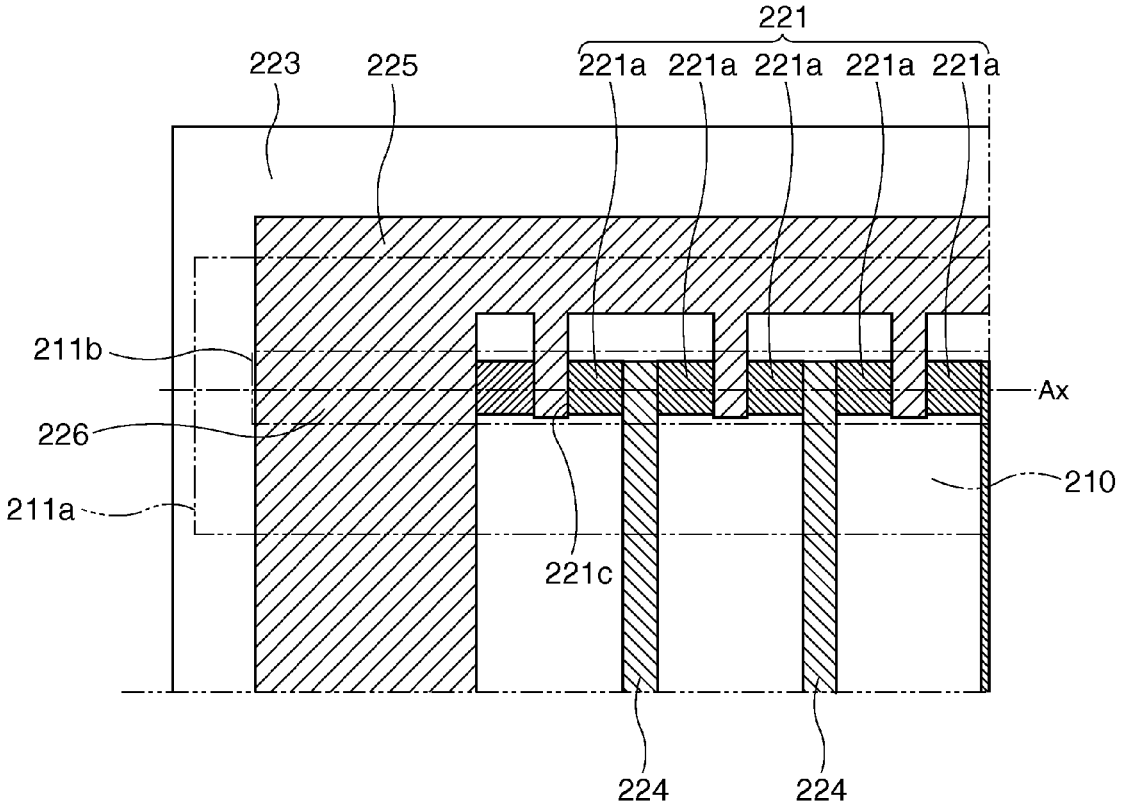
FIG. 9 is an enlarged front view of the thermal head in a thermal printer according to the related art.
Figure 10:
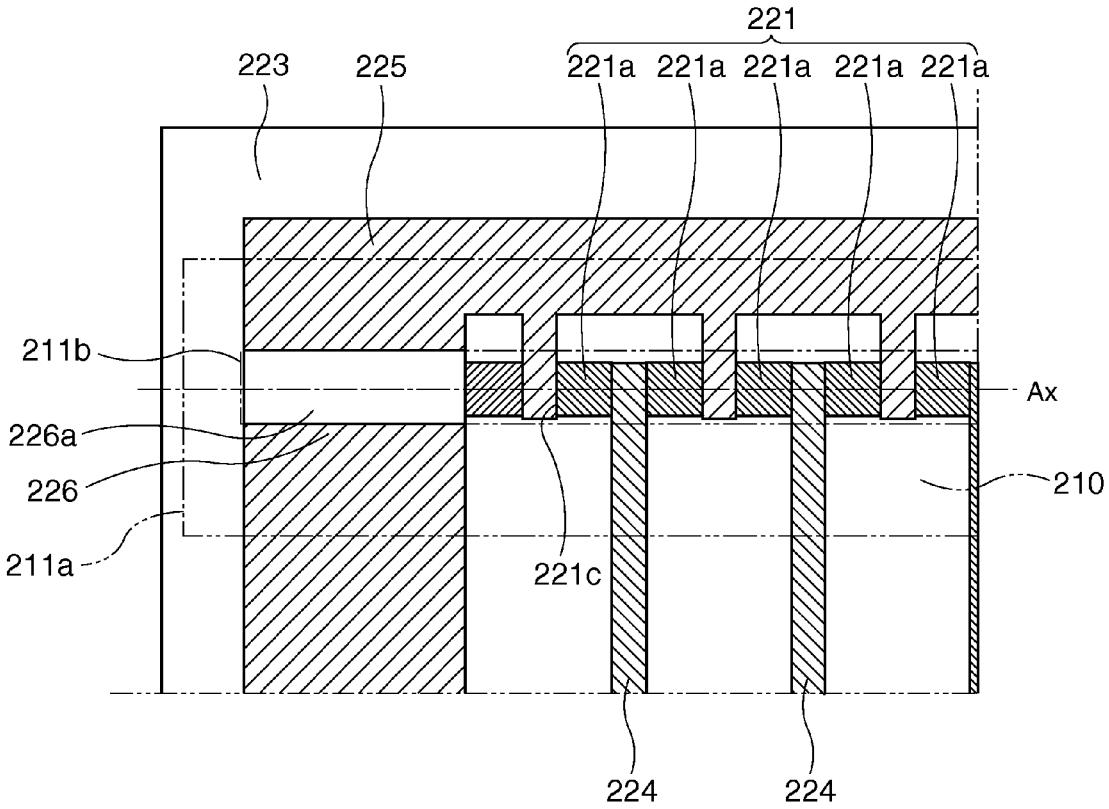
FIG. 10 is an enlarged front view of the thermal head in a thermal printer according to the related art.

To prevent such concentrated wear of the electrode connection unit 26, the print unit 30 according to this embodiment of the invention is built so that the contact surface 11 of the platen roller 10 does not push against the electrode connection unit 26. More specifically, as shown in FIG. 7, the receptive space A in which the axial end 11*a* part of the contact surface 11 of the platen roller 10 is positioned is formed between the heat unit 21 and the electrode connection unit 26 in the axial direction of the heat elements 21*a*. The contact surface 11 of the platen roller 10 thus pushes against the receptive space A where no electrodes are formed, pressure is not applied to the electrode connection unit 26 by the contact surface 11 of the platen roller 10, the electrode connection unit 26 therefore does not wear, and the common electrode 25 is not broken.

Note that as shown in FIG. 7 the receptive space A may be filled with borosilicate glass or other hard glass such as used in the coating 27. By thus separating the heat elements 21*a* and electrode connection unit 26 with a hard glass insulator, shorts between the heat elements 21*a* and electrode connection unit 26 caused by moisture getting into the receptive space A can be prevented.

In addition, by aligning the height of the top of the hard glass filler in the receptive space A with the top of the coating 27 formed on the heat unit 21, the contact surface 11 of the platen roller 10 can be pressed with uniform pressure against the entire surface of the heat unit 21 without concentrating stress only at the axial end 11*a* of the contact surface 11 of the platen roller 10. The service life of the thermal head 20 can therefore be extended because the coating 27 formed on the heat unit 21 can be made to wear evenly.

The dummy heat element 28 may also be disposed to the receptive space A. Because the heat elements 21*a* at the axial ends of the heat element array and the heat elements 21*a* in the middle of the array can be heated in the same way and print quality can be improved by providing a dummy heat element 28, and the function of the thermal head 20 can be maintained even if the dummy heat element 28 becomes exposed, the service life of the platen roller 10 can be increased. More specifically, while printing is disabled when the coating 27 becomes worn by the platen roller 10 and the electrode connection unit 26 or heat elements 21*a* are exposed, printing can continue even if the dummy heat element 28 becomes exposed because the dummy heat element 28 does not directly affect printing.

Furthermore, this embodiment of the invention describes forming a receptive space A to which the end 11*a* of the contact surface 11 of the platen roller 10 is positioned between the heat unit 21 and the electrode connection unit 26 in the axial direction of the heat elements 21*a*, but the invention is not so limited.

For example, the platen roller 10 may be formed so that, of the axial end of the heat elements 21*a* and the plural ends of the electrode connection unit 26 that are located on an extension of the axis of the heat elements 21*a*, the end 11*a* of the platen roller 10 contact surface 11 that is pressed to the thermal head 20 is positioned between the axial end of the heat elements 21*a* and the end 26*b* of the electrode connection unit 26 that is farthest from the heat elements 21*a*. This is because the print medium P is not pressed against all of the electrode connection unit 26 because the contact surface 11 of the platen roller 10 does not extend to the axial end 26*b* of the electrode connection unit 26, and the electrode connection unit 26 will not become completely interrupted. A thermal printer 1 that is protected against such electrode interruptions for a long time can therefore be provided.

The invention is described with reference to a preferred embodiment thereof above, but the technical scope of the invention is not limited to the scope of this embodiment. Various modifications and improvements that will be obvious to one skilled in the art are also possible without departing from the scope of the accompanying claims.

What is claimed is:

1. A thermal head to which a print medium is pressed through an intervening platen roller, comprising:

a heating unit having a plurality of heat elements arrayed on an axis; and an electrode unit formed on a linear extension of the axis;

wherein a receptive space to which an end part of the platen roller contact surface that is pressed to the thermal head is formed on the axis between the heating unit and the electrode unit.

2. The thermal head described in claim 1, wherein:

the receptive space is filled with hard glass.

3. The thermal head described in claim 2, wherein:

a dummy heat element that does not produce heat is disposed to the receptive space side end of the heating unit.

4. The thermal head described in claim 2, wherein:

a dummy heat element that does not produce heat is disposed to the receptive space.

5. The thermal head described in claim 1, wherein:

a dummy heat element that does not produce heat is disposed to the receptive space side end of the heating unit.

6. The thermal head described in claim 1, wherein:

a dummy heat element that does not produce heat is disposed to the receptive space.

7. A thermal printer comprising:

a thermal head including a heating unit having a plurality of heat elements arrayed along an axis, and an electrode unit formed on a linear extension of the axis with a receptive space between the electrode unit and the heating unit; and a platen roller that presses a print medium to the thermal head;

wherein an end part of the platen roller contact surface that is pressed to the thermal head is positioned in the axial direction to the receptive space.

8. The thermal printer described in claim 7, wherein: the receptive space is filled with hard glass.

9. The thermal printer described in claim 8, wherein:

a dummy heat element that does not produce heat is disposed to the receptive space side end of the heating unit.

10. The thermal printer described in claim 8, wherein:

a dummy heat element that does not produce heat is disposed to the receptive space.

11. The thermal printer described in claim 7, wherein:

a dummy heat element that does not produce heat is disposed to the receptive space side end of the heating unit.

12. The thermal printer described in claim 7, wherein:

a dummy heat element that does not produce heat is disposed to the receptive space.

13. A thermal printer comprising:

a thermal head including a heating unit that extends in a direction perpendicular to a print medium conveyance direction, and an electrode unit formed on a linear extension of the axis on which the heating unit extends; and a platen roller that presses the print medium to the thermal head;

wherein the electrode unit is formed on the axis of the heating unit at a position separated by a receptive space from the heating unit so that the platen roller does not press against the electrode unit.

14. The thermal printer described in claim 13, wherein:

the receptive space is filled with hard glass.

15. The thermal printer described in claim 14, wherein:

a dummy heat element that does not produce heat is disposed to the receptive space side end of the heating unit.

16. The thermal printer described in claim 14, wherein:

a dummy heat element that does not produce heat is disposed to the receptive space.

17. The thermal printer described in claim 13, wherein:

a dummy heat element that does not produce heat is disposed to the receptive space side end of the heating unit.

18. The thermal printer described in claim 13, wherein:

a dummy heat element that does not produce heat is disposed to the receptive space.

19. A thermal printer comprising:

a thermal head having an electrode unit formed on an extension of the alignment axis of a plurality of heat elements outside the area of the heat elements; and a platen roller that presses a recording medium to the thermal head;

wherein the platen roller is formed so that, of the axial end of the heat elements and the plural ends of the electrode unit located on an axial extension of the heat elements, an end part of the thermal head contact surface of the platen roller is positioned between the axial end of the heat elements and the end of the electrode unit that is located farthest therefrom.

20. The thermal printer described in claim 19, wherein:

the thermal head has a dummy heat element that does not produce heat on the axial end part of the heating unit; and the platen roller is formed so that the axial end of the contact surface overlaps the area where the dummy heat element is located.

* * * * *